United States Patent [19]

Dadbeh

[11] Patent Number: 5,071,120

[45] Date of Patent: Dec. 10, 1991

[54] COLLAPSIBLE BASKETBALL GOAL APPARATUS

[75] Inventor: Bemanali H. Dadbeh, Seal Beach, Calif.

[73] Assignee: Harvard Sports, Inc., Compton, Calif.

[21] Appl. No.: 616,204

[22] Filed: Nov. 20, 1990

Related U.S. Application Data

[63] Continuation of Ser. No. 120,661, Nov. 16, 1987, abandoned.

[51] Int. Cl.[5] ..... A63B 63/08

[52] U.S. Cl. ..... 273/1.5 R

[58] Field of Search ..... 273/1.5 R; 172/264–268, 705, 710

[56] References Cited

U.S. PATENT DOCUMENTS

| | | | |
|---|---|---|---|
| 2,776,614 | 1/1957 | Taule | 172/710 |
| 3,347,540 | 10/1967 | Sullivan | 172/264 X |
| 3,451,489 | 6/1969 | Sullivan | 172/264 X |
| 4,063,598 | 12/1977 | Boldrin | 172/705 |
| 4,140,348 | 2/1979 | Strada | 172/705 |
| 4,397,464 | 8/1983 | Krug | 273/1.5 R |
| 4,433,839 | 2/1984 | Simonseth | 273/1.5 R |
| 4,583,732 | 4/1986 | Allen | 273/1.5 R |
| 4,676,503 | 6/1987 | Mahoney et al. | 273/1.5 R |
| 4,799,679 | 1/1989 | Obram | 273/1.5 R |

FOREIGN PATENT DOCUMENTS

| | | | |
|---|---|---|---|
| 1390347 | 1/1965 | France | 172/705 |

*Primary Examiner*—Paul E. Shapiro

*Attorney, Agent, or Firm*—Irving Keschner

[57] ABSTRACT

A collapsible basketball apparatus which includes a backboard and a basketball hoop mounted to the backboard. The hoop is mounted to the backboard to be pivotable, via a release mechanism, about a horizontal axis parallel with the backboard between a first, horizontal position and a second, downwardly displaced position.

In a first embodiment, a plurality of curved springs are positioned in the release mechanism and mounted in a manner such that when a predetermined force is applied to the hoop, the compressive (restraining) force of the spring is exceeded and the hoop moves to the second position. When the force is released, the spring moves back to its original or horizontal position. In a second embodiment, a pin inclined slot and spring arrangement is utilized as the release mechanism to move the hoop to the second position when the predetermined force is applied to the hoop and to return the hoop to the horizontal position when the force is removed. In a third embodiment, a pressure loaded clamp joins the hoop to the backboard, application of a downward force of a predetermined amount to the hoop releasing the clamp and urging the hoop to the second position. The clamp is reset to its closed position after the force is removed, thus returning the hoop to the horizontal position.

8 Claims, 3 Drawing Sheets

FIG. 10
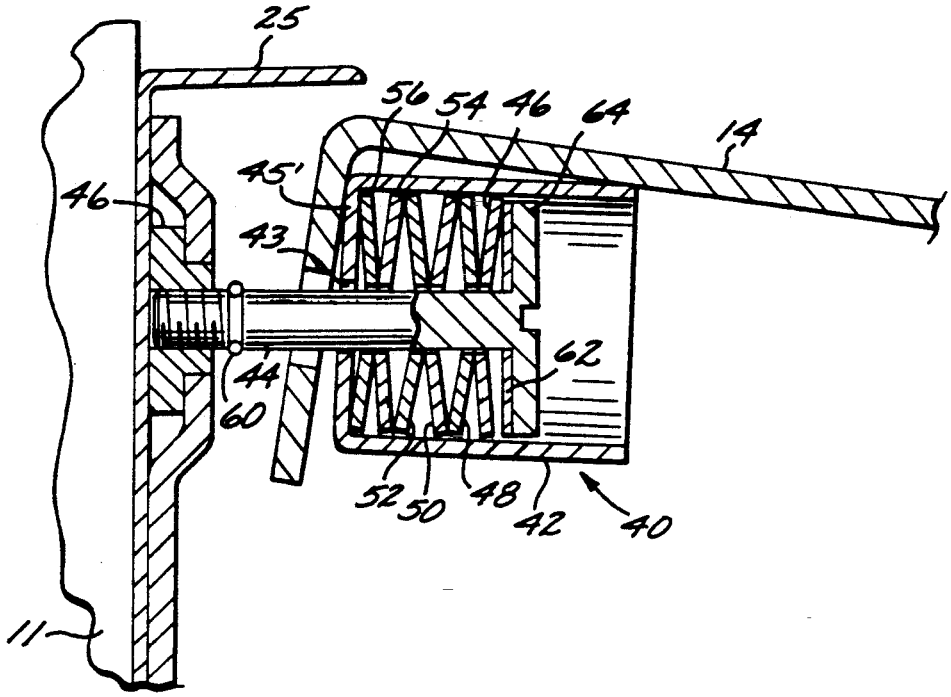
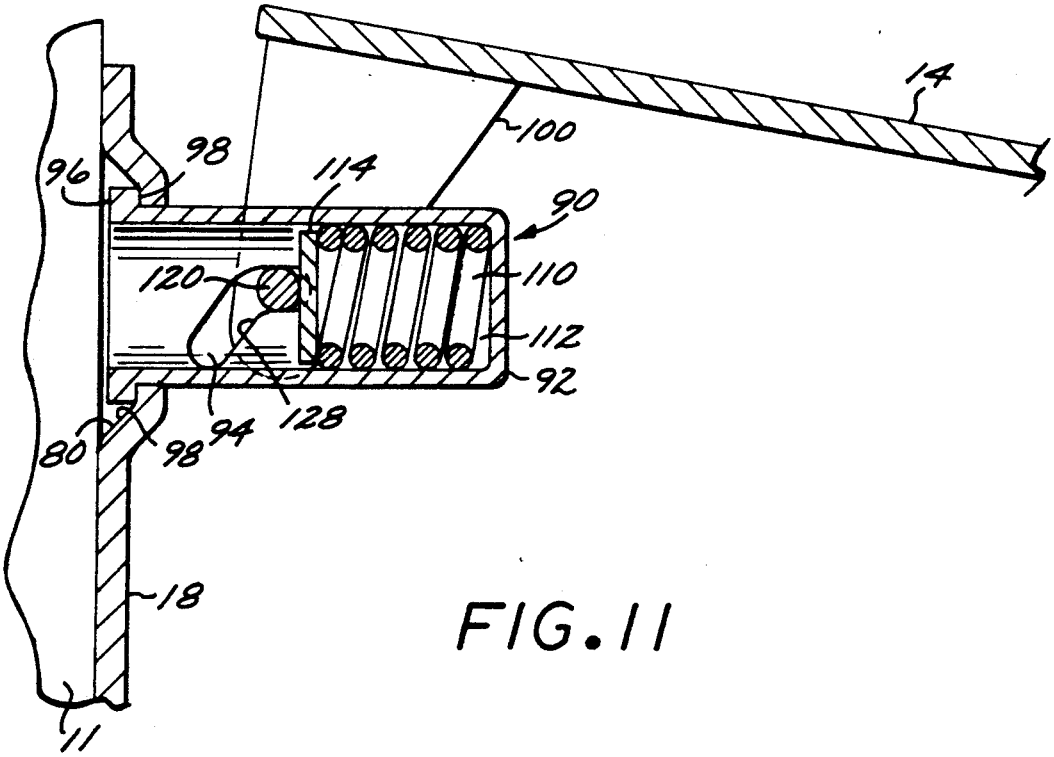
FIG. 11

COLLAPSIBLE BASKETBALL GOAL APPARATUS

RELATED APPLICATIONS

This application is a continuing application of Application Ser. No. 120,661, filed Nov. 16, 1987, abandoned.

BACKGROUND OF THE INVENTION

1. Field of the Invention

The present invention relates to the field of basketball goals, and particularly to a goal which is collapsible upon application of a predetermined downward force.

2. Description of the Prior Art

It has increasingly become a problem that rigidly mounted basketball goals cannot sustain the repeated impacts prevalent in the game of basketball. Many times during each basketball game the rim portion of the basketball goal will either be grasped by a player during a shot or rebounding, or will be actually impacted by a substantial downward force when the player is "dunking" the basketball. Such repeated forces have resulted in failures of the basketball goals, and in some instances has resulted in substantial or total damage to the backboard to which the goal is mounted. One method to compensate for this problem has been to design heavy duty backboards and goals. Typical of other approaches to the problem are disclosed in U.S. Pat. No. 4,441,709 to Schroeder et al., which discloses a movable basket rim which uses a compression system and rail/detent arrangement to maintain the hoop in a horizontal position until a force of at least 230 pounds is applied thereto. At this point the force applied to the hoop is sufficient to overcome the biasing of the detents; U.S. Pat. No. 3,820,784 to Boitano et al., which discloses a combination backboard and basketball goal, the goal being positionable between operative and inoperative positions using hand tools; U.S. Pat. No. 4,483,534 to O'Donnell, this patent disclosing a basketball goal mounting assembly which includes a resilient shock absorbing mass to absorb the shock when the goal hoop is deflected about a fulcrum due to downwardly directed forces, the force being greater than a predetermined amount; U.S. Pat. No. 4,438,923 to Engle et al., this patent utilizing a curved leaf spring and a double-acting shock absorber (piston device) to enable movement of a basketball hoop in a controlled manner; U.S. Pat. No. 4,575,079 to DeFaveri, this patent disclosing a plurality of resiliently biased bracket members to allow a basketball goal to defect and return to a normal horizontal position; U.S. Pat. No. 4,433,839 to Simonneth, this patent disclosing a basketball goal release mechanism which includes a tension resisting mechanism coupled to the rear surface of the basketball goal backboard; U.S. Pat. No. 4,534,556 to Estlund et al., this patent disclosing a basketball goal arrangement utilizing a metallic coil spring to return the goal to a horizontal position after it is deflected therefrom; U.S. Pat. No. 4,583,732 to Allen, this patent disclosing a breakaway basketball goal which utilizes a coil spring to both hold the goal in its operative horizontal position and to return it to that position after being deflected; and U.S. Pat. No. 4,397,464 to Krug which discloses the use of a shear member to release the hoop from the first position to the second position upon application of the predetermined downward force.

Although each of the aforementioned approaches have certain advantages associated with their use, each has particular disadvantages also. For example, the approach disclosed in U.S. Pat. No. 4,397,464 requires the replacement of the shear member and the retrieval of the collar and retainer members after the shear member has been sheared.

What is therefore desired is to provide a collapsible basketball apparatus with an improved release mechanism which is simple, sturdy in construction and inexpensive to manufacture.

SUMMARY OF THE INVENTION

The present invention provides a collapsible basketball apparatus which includes a backboard and a basketball hoop secured to the backboard. Mounting means secure the hoop, or rim, in a first, or horizontal, position when no external force is applied to the hoop and a second position, displaced from the horizontal position, when a predetermined force is applied to the hoop. Release means are provided for releasing the hoop from the first to second positions in response to a force exceeding the predetermined force. In accordance with the teaching of the invention, the release means comprises, in a first embodiment, a plurality of curved springs, the number and physical characteristics of the springs being selected to provide the desired release force while minimizing the size of the release means required. The characteristics of the springs are such that the goal is substantially rigid (maintained in the horizontal position) until the predetermined release force is exceeded, at which time the goal is displaced from the horizontal as noted above, thus insuring that the backboard does not fail.

The fact that the number of curved springs required to provide a desired release force is of a physical size which is substantially smaller than an equal coil spring in turn reduces the physical size of the release mechanism, the overall basketball goal apparatus thus being relatively inexpensive to manufacture, since the curved spring configuration cost is less than the coil equivalent coil compression spring configuration. The release mechanism is simple in construction and is designed for repeated use with no failure.

The second embodiment similarly provides a simplified release mechanism which is relatively inexpensive to manufacture and which utilizes either curved or coil springs in conjunction with a slot/rod arrangement to provide the release/return feature of the collapsible basketball goal apparatus.

The third embodiment of the release mechanism, although more expensive to manufacture than the first two embodiments, provides advantages over the prior art release mechanisms and uses a pressure clamp to releasably secure the hoop to the backboard.

DESCRIPTION OF THE DRAWINGS

For a better understanding of the invention as well as other objects and further features thereof, reference is made to the following description which is to be read in conjunction with the accompanying drawing wherein:

FIG. 10 is a cross-sectional view showing the goal in FIG. 3 in the collapsed position; and FIG. 11 is a cross-sectional view showing the goal of FIG. 7 in the collapsed position.

DETAILED DESCRIPTION OF THE INVENTION

Figure 1:
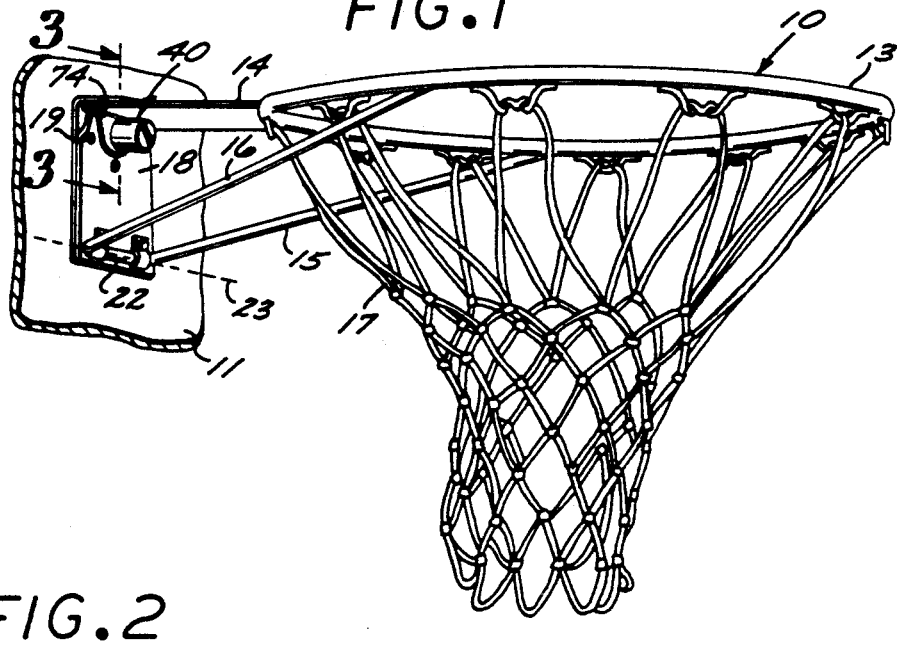
FIG. 1 is a perspective view of a basketball goal apparatus constructed in accordance with a first embodiment of the present invention.
Figure 2:
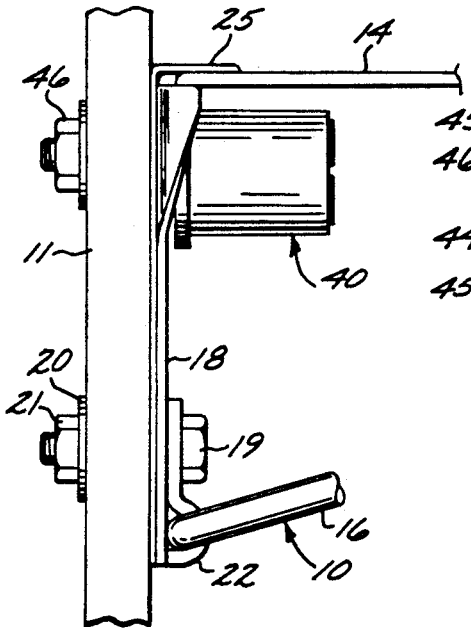
FIG. 2 is a side elevation view of the basketball goal apparatus of FIG. 1.
Figure 3:
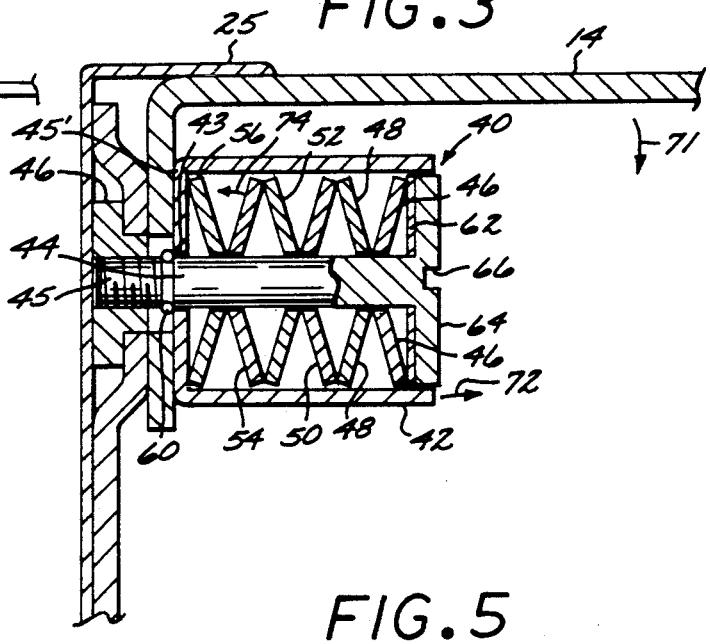
FIG. 3 is a cross-section view of the basketball goal apparatus along line 3—3 of FIG. 1.

Referring to the FIGS. 1-5, there is shown a basketball goal apparatus 10 constructed in accordance with the first embodiment of the present invention. The basketball goal apparatus includes a backboard 11 and a basketball hoop 12 mounted thereto. The hoop 12 includes a rim portion 13 to which is secured, typically by welding, an upper support member 14 and a pair of lower support members 15 and 16. A basketball net 17 is secured to the rim portion 13 in the usual fashion.

Mounting means are provided or mounting the basketball hoop 12 to the backboard 11 to have a first position with the hoop in a horizontal position, as shown in FIG. 1, and a second position with the hoop displaced downwardly from the first position as shown in FIG. 10. In the preferred embodiment, the mounting means includes a backboard bracket 18 secured to the backboard such as by bolts 19, washers 20 and nuts 21.

The lower support members 15 and 16 are pivotally mounted to the backboard bracket 18 to provide for pivoting about a horizontal axis at the lower part of the backboard bracket. Various means may be provided for such pivoting attachment. In the preferred embodiment, the lower support members 15 and 16 include inwardly extending portions, which may be connected, which are held against the backboard bracket 18 by means of a sleeve member 22. The sleeve member extends over the inwardly extending portions of the lower support members, and is secured to the backboard by means of the bolts 19 which also secure the backboard bracket to the backboard. It will be appreciated form the drawings that the basketball hoop 12 is pivotable downwardly about the axis 23, which extends through the center of the inwardly-extending portions of the lower support members, if or when the upper support bracket 14 is displaced from the backboard bracket. A shield member 25 is provided to prevent accidental pinching of a user's finger.

In the first position of the basketball hoop, the upper support member 14 is secured to the backboard bracket by the following attachment means. This attachment means is for attaching the upper support member to the backboard, and in the preferred embodiment to the backboard bracket, to provide for releasing the upper support member form the backboard bracket and for releasing the basketball hoop from the first position to the second position. Secured to or integral with the upper support member 14 is a hoop bracket 24. The hoop bracket 24 preferably has a generally concave configuration facing the backboard bracket, which backboard bracket similarly has a convex portion facing the hoop bracket and shaped complementary therewith. This use of matching surfaces facilitates alignment of the mechanism and also provides additional lateral stability for the mounting structure.

In accordance with the teaching of the first embodiment of the present invention, the release mechanism 40 comprises a rigid cylindrical collar member 42 having a bolt, or post, 44 with a threaded portion 45 passing through aperture 43 and aligned apertures in the depending leg 45 of hoop bracket 14 and the backboard bracket 18. Collar 42 is closed by at one end by an integral rigid portion 45' having an aperture 43 therethrough aligned with apertures in the hoop bracket 14 and backboard bracket 18, aperture 43 being slightly larger than the diameter of bolt 44. It should be noted that a separate rigid plate attached to one end of a cylindrical collar member having open ends could also be utilized. The release mechanism is secured to the backboard bracket 18 via bolt 44 and nut 46.

Incorporated within the collar housing are a plurality of curved springs (also referred to in the trade as disk springs or washers and Belleville washers) 47, 48 . . . 56, each having an aperture therein through which the bolt 44 passes. As will be discussed in more detail hereinafter, a curved spring provides a compressive force which is related to the height/width ratio, the material thickness, etc. of the spring. Since the present invention requires a resistance force of approximately 1,700 pounds per square inch, a plurality of such springs is mounted in the collar housing and successfully utilized. The particular arrangement and placement of the springs may be varied to provide the desired release force and physical size. A retainer ring 60 is provided to make an integral unit assembly 40 including bolt 44 and the plurality of springs. A retaining plate 62 maintains the springs within the collar member, the head 64 of post 44 having a recess 66 to received a screwdriver to mount the release mechanism to bracket 18. The inside diameter of collar 42 is slightly greater than bolt head 64.

The use of curved springs provides numerous advantages for collapsible basketball goal apparatus. In particular, the characteristics of the spring provide a basketball rim which is substantially rigid until a substantial downward force is applied to the basketball rim at which time the basketball apparatus pivots downward in the direction of arrow 71 about sleeve 22 as the collar member moves in the direction of arrow 72, the springs being forced at the same time to be compressed in the direction of arrow 74. Once the downward force is removed, the basketball apparatus returns to its original horizontal position by the return force of the springs, in the direction opposite to arrow 74, forcing collar member 42 to move in the direction opposite to arrow 72.

It should be noted that collar member 42 acts as a rotary to linear force transfer mechanism as it is moved in the direction of reference arrow 72 by the downward force (arrow 71) applied to the rim/mounting bracket such that the springs are prevented from binding in a manner such that they cannot move along post 44, thus in turn preventing the rim from collapsing. In essence, without the use of collar 42 between support member 14 and spring member 56, the upper edge of spring 56, made of hardened steel, will cut into the softer steel of member 14. In addition, the portion of spring 56 engaging bolt 44 will also bind thereagainst. In this situation, spring 56 will be unable to move and otherwise will render the collapsible basketball goal inoperable. Collar 42, inter alia, separates the edge of spring 56 from engaging support member 14 and forces the spring, when downward force is applied to the rim, along the spring edge, also eliminating the second binding point. Any rigid, apertured transfer member interposed between support member 14 and spring 56 will prevent the aforementioned binding effect.

Figure 4:
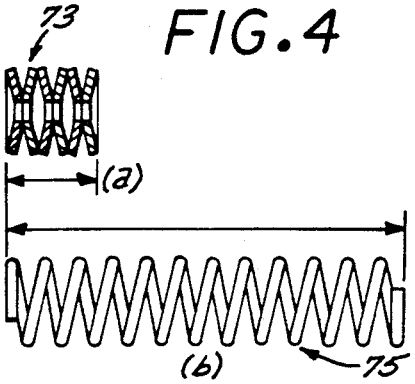
FIGS. 4(*a*) and (*b*) and 5 depict the relative physical size of the curved spring utilized in the present invention in contrast to an equivalent (in compressive force) coil spring and a force versus displacement curve, respectively.
Figure 5:
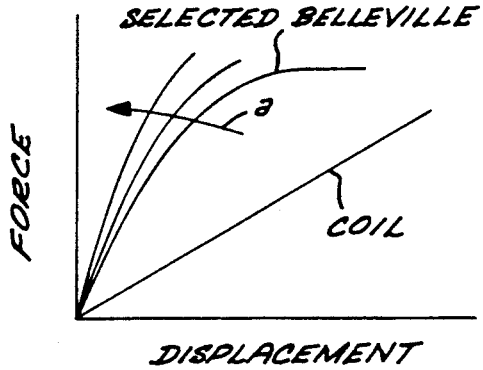
Figure 6:
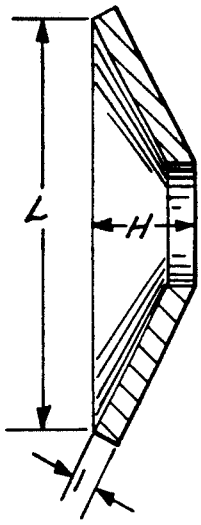
FIG. 6 illustrates a typical curved spring.

The overall physical size of the curved spring arrangement required to provide a desired release force is substantially less than the equivalent coil spring. FIGS. 4(*a*) and (*b*) show, in a simplified representation of the size differential the curved spring arrangement 73 providing an approximate compressive force of 1,700 pounds having a length of 1.125 inches and diameter of 1.25 inches; the coil spring 75 having a diameter of 1.5 inches and a length of 4 inches. Thus, the release mechanism shown in the FIG. 1–5 embodiment is smaller-sized (and also mechanically less complex) than prior art spring-based release mechanisms, making the overall apparatus less expensive to fabricate. As illustrated in FIG. 5 and 6, the force/displacement ratio for a curved spring is dependent on the h/t ratio of the spring, h being the height dimension as illustrated and t the thickness of the spring. As shown in FIG. 5, the force versus displacement curve of a typical coil spring and a series of curved springs show that the coil spring curve is almost linear, meaning that the rim is not rigid if the release mechanism incorporates a coil spring. On the other hand, as the h/t ratio of the curve spring is increased (illustrated by arrow a), the rigidity of the basket goal rim is also increased.

The shape of the curved spring could be round, curved beam (rectangular shape), the shape not being important as long as the springs set the proper compressive force. Other types of springs, such as a wave spring, can be utilized. Examples of such springs and the design technique utilized to design a spring to provide a desired compressive force is shown, for example, in Design Handbook, Springs, Custom Metal Parts, published by the Associated Spring Corporation, Bristol, Connecticut in 1970.

Figure 8:
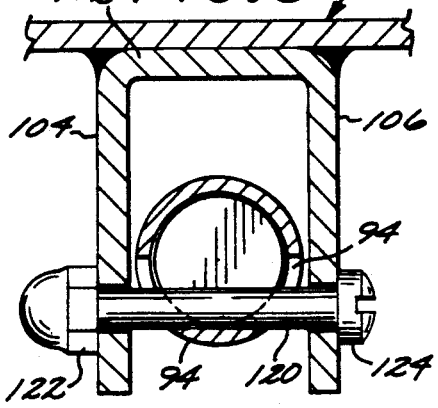
FIG. 8 is a cross-sectional view of the basketball goal apparatus of FIG. 7 along line 8—8 of FIG. 7.
Figure 7:
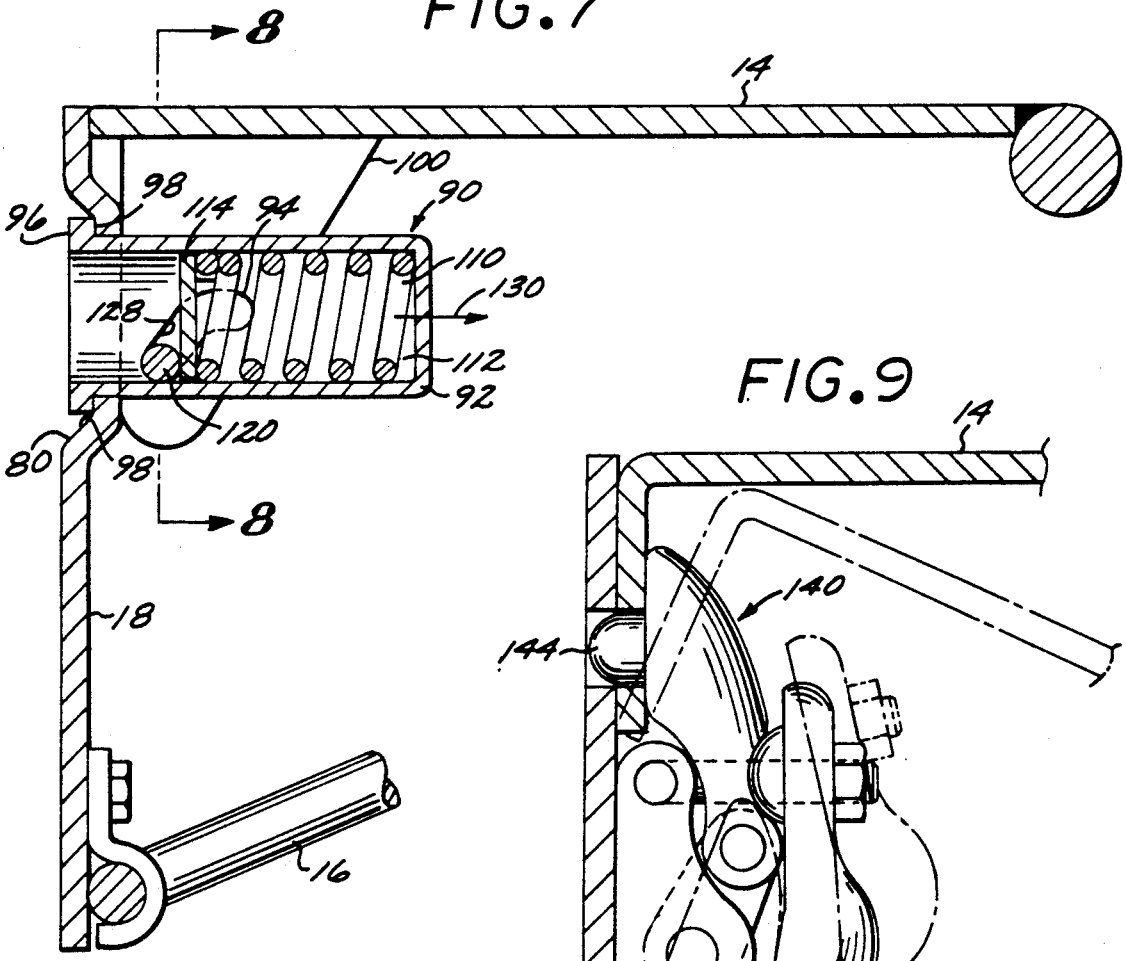
FIG. 7 is a cross-sectional view of a basketball apparatus constructed in accordance with a second embodiment of the present invention.

FIG. 7 is a perspective view of a basketball goal apparatus constructed in accordance with a second embodiment of the present invention (it should be noted that identical reference numerals in each of the figures refer to identical components). Since the basic components of the basketball goal apparatus have been described with reference to FIGS. 1–5, only the release mechanism will be described in detail herein. In this embodiment, hoop bracket 24 shown in FIGS. 1–5 is eliminated and backboard bracket 18 is slightly modified to include an aperture recess portion 80 and a release member 90 is provided which includes a cylindrical housing member 92 having a slanted "L" slot-shaped portion 94 formed on opposite ends of the housing 92. The housing 92 includes a base portion 96 configured in a manner such that the upper surface of the base portion 98 is fit to the adjacent surface of the bracket 18. A "U" shaped frame member 100 comprising a baseplate 102 and two leg portions 104 and 106 and baseplate 102 is joined to the lower surface of the upper support member 14 by welding baseplate 102 thereto. In the embodiment illustrated, a coil spring 110 is positioned within chamber portion 112 of release member 90, a movable retaining plate 114 being positioned within the chamber 112 as illustrated. According to the teaching of this embodiment of the present invention, a rod member 120 is positioned through aligned apertures formed in leg portions 104 and 106 and in slot portion 94 formed on both sides of cylindrical member 92 as illustrated in FIG. 8. The rod is secured therein by set screw 122 and nut 124 or a retaining ring.

As noted hereinabove with respect to the embodiment shown in FIGS. 1–5, the coil spring 110 is selected to provide the desired release force (a plurality of curved springs having an equivalent release force design can be utilized in place of the coil spring 110 illustrated).

In operation, when a substantial downward force is applied to the basketball rim, this force is transmitted to release member 90 via bracket 100. This force cause rod 120 to move up the angled slot portion of opening 94 along edge 128. As rod 120 travels along this inclined edge 128, the force applied thereto, in essence, comprises horizontal and vertical components. As the rod continues to move upwardly, the force applied to plate 114 tends to drive the spring 110 in the direction of arrow 130. When sufficient force is applied to the rod 120, i.e. a force exceeding the predetermined release force, the rod 120 is driven further up along the edge until it enters the horizontal portion of the slot 94. At this point, all the force is applied directly to the rod in the horizontal direction and is of a sufficient magnitude to drive the coil spring in the direction of arrow 130 causing the basketball goal apparatus to be force downwardly, as shown in FIG. 11, thus absorbing the energy applied to the basketball goal rim. When the force is released, the reverse action results. In this embodiment the edge resists the movement of the rod such that substantial rigidity of the basketball rim is maintained until the predetermined force is exceeded at which time a rapid action of the release mechanism occurs. In addition to providing the rigidity features noted hereinabove, the relative simplicity of the release mechanism described makes the fabrication thereof relatively inexpensive compared to prior art release mechanisms.

Figure 9:
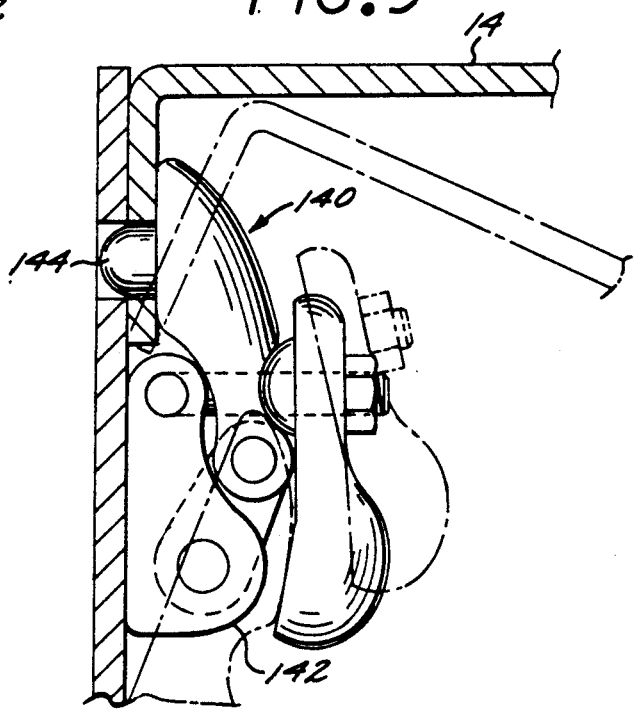
FIG. 9 is a perspective view of a basketball goal apparatus constructed in accordance with a third embodiment of the present invention.

Referring now to FIG. 9, a third embodiment of the basketball goal apparatus of the present invention is illustrated. In this embodiment, a pressure-loaded clamp system 140 is utilized as the release mechanism and is illustrated in the closed position. The clamp system includes a base portion 142 which is mounted to the backboard at bracket 18, a portion of the clamping system 140 including a protrusion 144 which extends into an aperture in the bracket 18 as illustrated. The pressure-loaded clamp system is adjusted to exert approximately 1,700 pounds of pressure in the closed position such that when the excess force is applied to the goal rim 13 as described hereinabove with reference to the first two embodiments, the clamping system opens at that point to the position illustrated in phantom.

The pressure-loaded clamp system 140 similarly provides a rigid system such that the goal stays in a substantially horizontal position in most situations and only is cause to be displaced form the horizontal when the release force is exceed. The clamp system 140 is reset to its clamped position when the apparatus is to be used.

The present invention thus provides a number of advantages over prior art basketball goal apparatus release mechanisms. In the first embodiment described, the fact that the number of curved springs required to provide a desired release force is of a physical size which is substantially smaller than an equal coil spring in turn reduces the physical size of release mechanisms which utilize compression springs. The overall basketball goal apparatus is thus relatively inexpensive to manufacture, in view of the fact that the curved spring configuration cost is less than the equivalent coil compression spring configuration and due to its smaller physical size. The release mechanism is simple in construction, is rigid in the sense that the goal stays in a substantially horizontal position until the release force is exceeded, and is designed for repeated use with no failure.

The second embodiment similarly provides a simplified release mechanism which is relatively inexpensive to manufacture and which utilizes either curved or coil springs in conjunction with a slot/rod arrangement to provide the release/return feature of the collapsible basketball goal apparatus.

The third embodiment of the release mechanism, although more expensive to manufacture than the first two embodiments, provides advantages over the prior art release mechanisms and uses a pressure clamp to releasably secure the hoop to the backboard.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed:

1. A collapsible basketball goal apparatus which comprises:

a backboard adapted for mounting on a suitable support;

a basketball hoop adapted for carrying a basketball net;

mounting means for mounting said hoop to said backboard to have a first position with said hoop in a horizontal position and a second position with said hoop displaced downwardly from the first position, said mounting means including a backboard bracket, a lower support member and an upper support member including an aperture, the backboard bracket being secured to said backboard, the lower support member being attached to said hoop and further being hingedly attached to the backboard bracket about a horizontal axis parallel with said backboard at a first location, the upper support member being attached to said hoop, an attachment means for attaching the upper support member to said backboard, the attachment means including a post member mounted to said backboard bracket and received through the aperture in the upper support member; and release means for releasing said hoop from the first position to the second position in response to a predetermined downward force upon said hoop, said release means comprising a rigid cylindrical collar member having a rigid member closing one end thereof, said rigid member having an aperture therein slightly larger than said post member, said cylindrical collar member having an inside diameter slightly larger than the diameter of said post member, spring means comprising a plurality of curved spring members positioned within said collar member, said post member extending within said collar member and through the spring means therein, the aperture in said rigid member, said aperture in the upper support member and said backboard bracket, means attached to the end of said post member extending through said backboard bracket to secure said post member to the upper support member, said securing means having a diameter slightly smaller than the inside diameter of said collar member; means for maintaining said spring means within said collar member, said collar member moving in a horizontal direction away from said backboard bracket upon application of the predetermined downward force thus moving the upper support member away from said backboard and releasing said hoop from the first position to the second position, said collar member transferring the downward force applied to the hoop to a substantially horizontal force applied to said curved spring members, thus enabling the spring member furthest removed from said maintaining means to move along said post member when said downward force is applied to said hoop.

2. The apparatus of claim 1 wherein the application of said downward force upon said hoop compresses said spring means in a direction away from said backboard, removal of said force causing said spring means to move in a direction towards said hoop to said first position.

3. The apparatus of claim 1 wherein said hoop maintains a substantially rigid first position until the application of said predetermined force.

4. A collapsible basketball goal apparatus which comprises:

a backboard adapted for mounting on a suitable support;

a basketball hoop adapted for carrying a basketball net;

mounting means for mounting said hoop to said backboard to have a first position with said hoop in a horizontal condition and a second position with said hoop displaced downwardly from the first position, said mounting means including a backboard bracket, lower support member and an upper support member, the backboard bracket being secured to said backboard, the lower support member being attached to said hoop and further being hingedly attached to the backboard bracket about a horizontal axis parallel with said backboard at a first location, the upper support member being attached to said hoop; and means for attaching the upper support member to said backboard bracket and for releasing said hoop from the first position to the second position in response to a predetermined downward force upon said hoop, said release means comprising a cylindrical member extending in a horizontal direction and secured at one end to said backboard bracket, substantially identical slots being formed on opposite surfaces of said cylindrical member; spring means; means for retaining said spring means within said cylindrical member; a rod member extending from said first slot through the interior of said cylindrical member and exiting through said second slot, said rod member being movable within said slots; and a flange member comprising first and second leg portions and a base portion, said base portion being connected to said upper support member, said first and second leg portions each having apertures at one end and positioned adjacent the slots on the surface of the cylindrical member such that the rod member extends through the apertures, said rod member moving within said slot portions upon application of the predetermined downward force, said release means releasing the upper support member away from said backboard and said hoop from the first position to the second position by such movement of the rod within said slots.

5. The apparatus of claim 4 wherein said slots comprise inclined and horizontal portions.

6. The apparatus of claim 5 wherein said upper support member remains in a substantially horizontal position as the rod member moves along the edge of the inclined portion of said slots.

7. The apparatus of claim 6 wherein said upper support member is released to said second position when said rod member enters the horizontal portion of said slots.

8. The apparatus of claim 4 wherein said hoop maintains a substantially rigid first position until the application of said predetermined force.

* * * * *